US007331478B2

(12) United States Patent
Aljadi

(10) Patent No.: US 7,331,478 B2
(45) Date of Patent: Feb. 19, 2008

(54) DUAL CHAMBER NURSERY BOTTLE

(76) Inventor: Salma E. Aljadi, P.O. Box: 23259, Safat 13093 (KW)

( * ) Notice: Subject to any disclaimer, the term of this patent is extended or adjusted under 35 U.S.C. 154(b) by 0 days.

(21) Appl. No.: 11/188,075

(22) Filed: Jul. 25, 2005

(65) Prior Publication Data

US 2007/0017890 A1 Jan. 25, 2007

(51) Int. Cl.
*A61J 9/00* (2006.01)
*B65D 23/04* (2006.01)

(52) U.S. Cl. ..... 215/11.4; 215/6; 215/11.1; 220/502

(58) Field of Classification Search ..... 215/11.1, 215/11.4, DIG. 8, 6, 10; 220/502, 4.27
See application file for complete search history.

(56) References Cited

U.S. PATENT DOCUMENTS 2,372,281 A * 3/1945 Jordan ..... 215/11.5
2,843,281 A * 7/1958 Gallois ..... 215/11.1
3,211,315 A * 10/1965 Griesinger ..... 215/11.1
3,410,444 A * 11/1968 Morane ..... 206/219
4,444,324 A * 4/1984 Grenell ..... 215/6
4,703,863 A * 11/1987 Kohus ..... 215/11.1
4,779,722 A * 10/1988 Hall ..... 206/221
4,856,995 A * 8/1989 Wagner ..... 433/215
5,060,811 A * 10/1991 Fox ..... 215/6
5,275,298 A * 1/1994 Holley et al. ..... 215/11.4
5,593,052 A * 1/1997 McGee ..... 215/11.1
5,634,714 A * 6/1997 Guild ..... 366/130
5,638,968 A * 6/1997 Baron et al. ..... 215/11.4
5,758,786 A * 6/1998 John ..... 215/6
6,116,439 A * 9/2000 Yaniv ..... 215/11.1
6,945,393 B2 * 9/2005 Cho ..... 206/219
7,150,369 B1 * 12/2006 Fryar ..... 215/11.4
2006/0049127 A1 * 3/2006 Katz et al. ..... 215/6

* cited by examiner

*Primary Examiner*—Sue A. Weaver
(74) *Attorney, Agent, or Firm*—Lowe Hauptman Ham & Berner, LLP

(57) ABSTRACT

A dual chamber nursery bottle including upper and lower cylindrical shaped chambers disposed on a common axis one above the other and separated from one another by a rotatable valve assembly that is disposed on the common axis and in contact with the upper and lower chambers.

1 Claim, 2 Drawing Sheets

DUAL CHAMBER NURSERY BOTTLE

FIELD OF THE INVENTION

This invention relates to a dual chamber nursery bottle and more particularly to a dual chamber nursery bottle with upper and lower chambers disposed on a common axis.

BACKGROUND FOR THE INVENTION

It is well know that the use of nursing bottles can contribute to tooth decay and that frequent and long exposure to sugar can be particularly detrimental to a baby's teeth. It has also been recognized that it is desirable to take preventive measures against tooth decay at an early stage, as for example, the appearance of the first baby or milk teeth. A common preventive approach is to remove traces of sugars which are contained in most liquid nutrients from a baby's mouth after feeding. A common technique for removing traces of sugars from a baby's mouth is to feed the baby water following feeding with a nutrient.

As a result of the above, a number of dual and multi chamber nursing bottles have been developed. For example, a U.S. Pat. No. 4,856,995 of Wagner disclosers a nursing bottle having a pair of side-by-side reservoirs which are selectively coupled to a single nipple. The bottle includes a hollow body, an intermediate ring having a valve disc with two apertures and a nipple carrier having a valve plate with a single aperture. The nipple carrier is mounted over the intermediate ring and rotates to selectively connect the valve plate aperture with one of the valve disc apertures.

Another approach to a dual chamber nursing bottle is disclosed in the U.S. patent of Herrmann, U.S. Pat. No. 5,437,381 for a nursing bottle. As disclosed, a dual compartment nursing bottle for preventing carries in infants includes a valve-less dual compartment bottle. The bottle includes a first container defining a first compartment having a neck portion with a nipple and a second container defining a second compartment provided with a closure member having at least one relatively narrow outlet port for the second compartment.

A U.S. patent of John, U.S. Pat. No. 5,758,786 discloses a multi compartment baby bottle wherein the bottle is divided into multiple compartments by a series of vertically extending partitions radiating from a central axis. A nipple is attached to a collar which in turn is attached to the mouth of the container. The nipple includes a base portion having an aperture radially offset from the central axis of the nipple and which is adapted to register with only one of the compartments depending on the relative angular orientation of the nipple and the collar.

A still further approach to baby bottles with two separate fluid chambers is disclosed in a U.S. patent of McGee, U.S. Pat. No. 5,593,052. McGee discloses a divided fluid container for storing two fluids in a single bottle. A stopper attached to an annular flange of a flexible nipple is inserted into the opening of a cavity on one side of the bottle. A threaded collar presses the flange of the nipple against the rim of the bottle to make a fluid tight seal. Further, a ring supported by a stem connected to an anchor inside the stopper allows a user to remove the stopper when desired after removal of the threaded collar.

Notwithstanding the above, it is presently believed that there may be a large commercial market for an improved dual chamber nursery bottle in accordance with the present invention. There should be a commercial market for such bottles because they facilitate rinsing a baby's mouth and therefore should reduce tooth decay in infants. In addition, such bottles enable a mother to dilute a nutrient such as milk with water during feeding and without removing the nipple from the baby's mouth. A further advantage of such bottles is that they are easy to clean using the same brushes and techniques used in washing conventional nursing bottles.

It is also believed that the nursing bottles in accordance with the present invention can be manufactured and sold at a competitive cost, are durable and of relatively lightweight. Other advantages will be apparent from the following specification.

BRIEF SUMMARY OF THE INVENTION

In essence, the present invention contemplates a dual chamber nursery bottle having upper and lower cylindrically shaped chambers for containing a first liquid such as milk or other liquid nutrient in the upper chamber and a second liquid such as water in the lower chamber. The upper chamber defines an open mouth with a rim around the open mouth. A flexible nipple and collar position the nipple in sealing engagement with the rim. The chambers are disposed one above the other along a common axis and are separated by a valve assembly. The valve assembly prevents liquid from the lower chamber from entering the upper chamber when the valve in the valve assembly is in a closed position. Then, when the baby has consumed the liquid from the upper chamber, the valve is open and a second liquid such as water flows through the upper chamber and out of the nipple. For example, when the liquid in the lower chamber is water, the water rinses the baby's mouth.

In a preferred embodiment of the invention, a dual chamber nursery bottle includes an upper chamber for containing a liquid nutrient such as milk or juice and a lower chamber for containing a second liquid such as water that may be used for rinsing a baby's mouth after consumption of a liquid nutrient. In this embodiment of the invention, the upper chamber includes an opened mouth with a peripheral rim and an open end with a threaded portion surrounding the rim. The nursery bottle also includes a flexible nipple having an outer flange engaging the rim and with the threaded collar engaging the threaded portion of the upper chamber. The threaded collar presses the flange of the nipple against the rim to form a fluid type seal.

The upper chamber also includes a second opening in a bottom portion thereof and a second threaded portion surrounding the second opening. The lower chamber forms a reservoir with an opening in its upper portion and a threaded portion around an outer periphery of the opening. In addition, a twist or a rotary valve assembly having a cylindrical shape, an upper and lower threaded portion on an outer surface thereof is disposed between the upper and lower chambers and is threaded and sealingly attached to the upper and lower chambers by engagement with the threaded portions on the upper and lower chambers.

Twisting or turning the valve assembly in a first direction closes the valve and prevents liquid from the lower chamber from entering into the upper chamber when the bottle is tilted to feed a baby. Then, when the baby has consumed all of the liquid in the upper chamber, the valve assembly is rotated or twisted in the opposite direction to open the valve to allow the liquid from the lower chamber to flow through the upper chamber for rinsing the baby's mouth. After consumption the nursery bottle can be readily disassembled and cleaned in a normal fashion.

The invention will now be described in connection with the accompanying drawings wherein like references numbers are used to define like parts.

DESCRIPTION OF THE PREFERRED EMBODIMENT OF THE INVENTION

Figure 1:
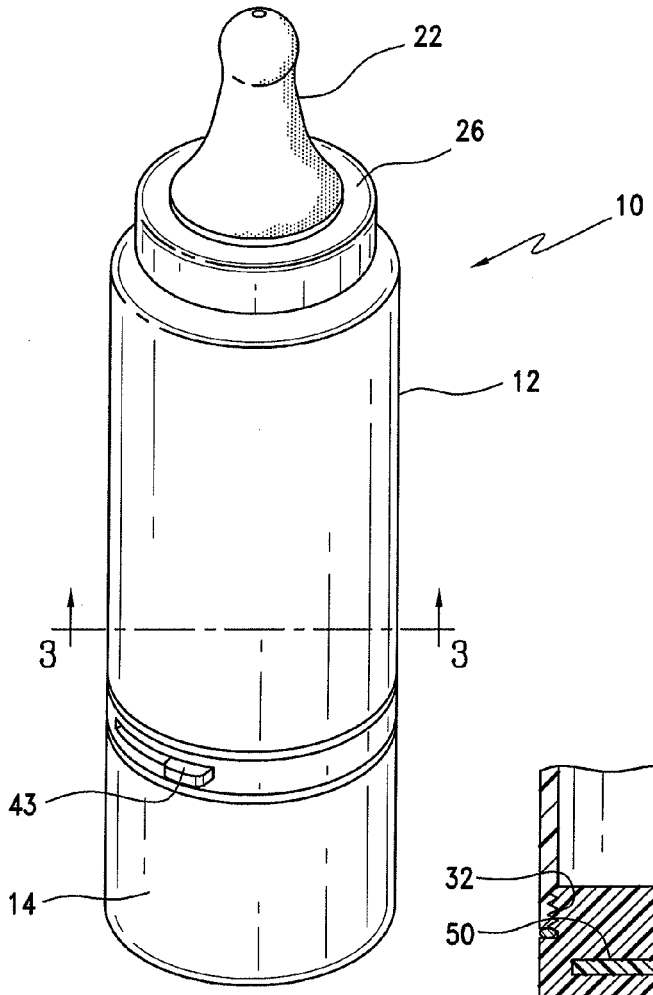
FIG. 1 is a side elevational view of a dual chamber nursery bottle in accordance with the present invention.
Figure 2:
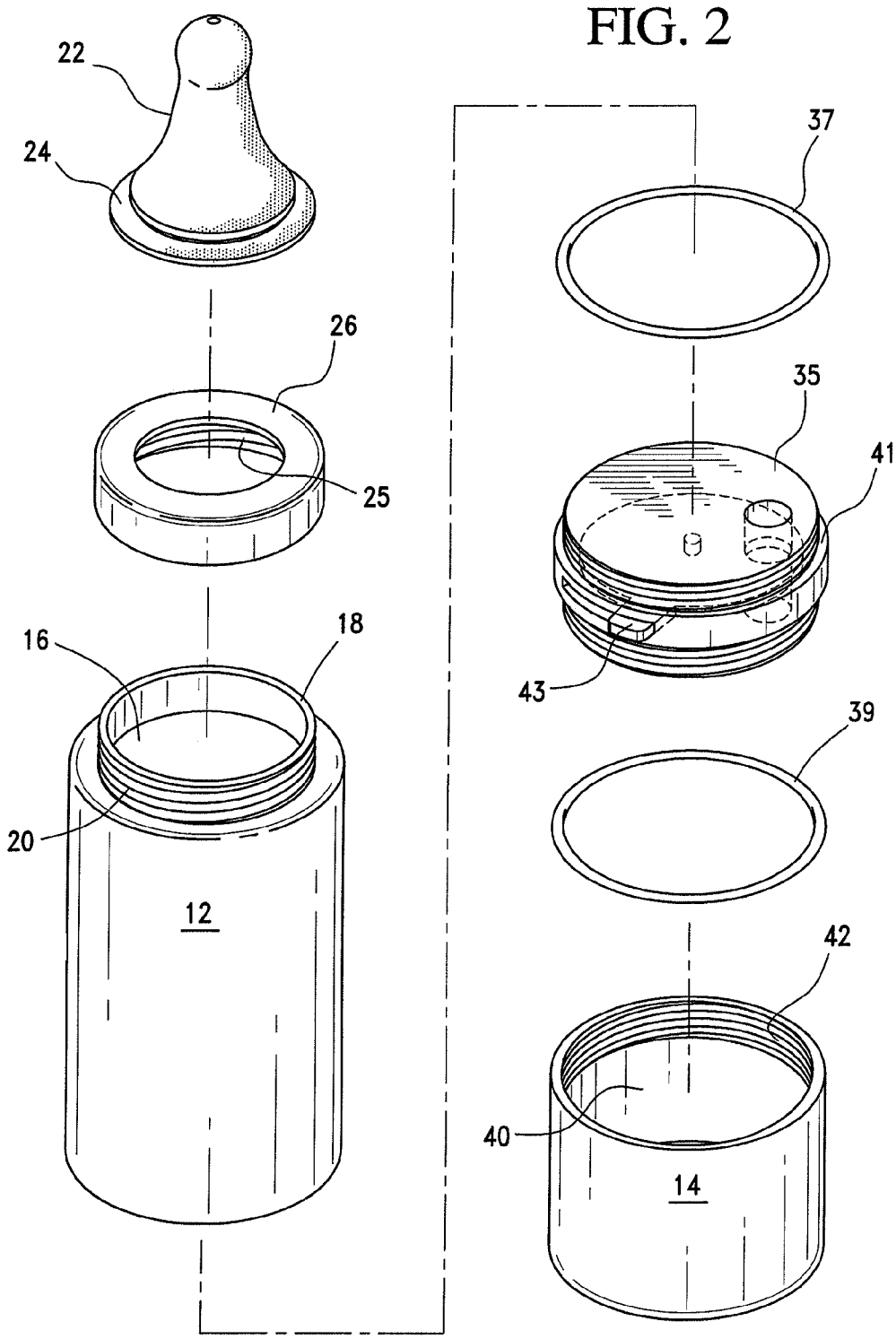
FIG. 2 is an exploded perspective view of the nursery bottle shown in FIG. 1.

An improved dual chamber nursery bottle in accordance with the present invention is shown in FIGS. 1 and 2. As shown, a dual chamber nursery bottle 10 includes an upper chamber 12 and lower chamber 14 disposed on a common axis with the chamber 12 above or on top of the chamber 14. The upper chamber 12 is typically filled with a liquid nutrient such as milk or juice for feeding a baby while the lower chamber is filled with water that may be used subsequently to rinse the baby's mouth after consumption of the liquid nutrient.

As shown more clearly in FIG. 2, the upper cylinder includes an open mouth 16 with a peripheral rim 18 at an upper end thereof and a threaded portion 20 that surrounds the rim in a conventional manner. The nursery bottle 10 also includes a conventional flexible nipple 22 having an outer flange 24 that is in contact with the rim 18. A conventional collar 26 having internal threads 25 is screwed onto the threaded portion 20 of the upper chamber 12 and presses the outer flange 24 against the rim 18 to form a tight seal in the same manner as in a conventional single chamber baby bottle.

The upper chamber 12 also includes a second opening 30 on the lower portion or bottom thereof and a second threaded portion 32 surrounding the second opening 30. In a preferred embodiment of the invention, the second threaded portion 30 are on the internal surface of the chamber 12. The lower chamber 12 is then connected to the upper chamber 12 by means of a rotary valve 35. The rotary valve 35 has an upper threaded portion 36 and lower threaded portion 38. The upper threaded portion 36 meshes with the second threaded portion 30 to connect the valve 35 to the upper chamber 12 aligned along the common axis.

The lower chamber 14 forms a reservoir with an upper mouth 40 and upper threaded portion 42 surrounding the mouth 40. The lower chamber 14 is after filling with water attached to the rotary or twist valve 35 by being threaded onto the lower threaded portion 38 of the valve 35. A pair of O-rings 37 and 39 or suitable seals of elastomer are disposed between the bottom of the chamber 12 and top of a flange 41 to form a seal between the rotary valve 35 and the upper chamber 14 and lower chamber 12.

After filling the lower chamber 14 with water, the upper chamber 12 and lower chamber 14 containing water and twist valve 35 are assembled and tightened to minimize any likelihood of leakage. The upper chamber 12 is then filled with milk or the like and the nipple 22 and collar 26 attached in a conventional manner. As a baby is being fed, the rotary valve 35 may be opened, if it is desirable to dilute the nutrient. However, in most cases the valve 35 will remain closed until the upper chamber is empty. Then without the necessity to remove the nipple from the baby's' mouth, the rotary valve 35 is opened by lever 43 so that water flows through the upper chamber 12 and out through the nipple 22 to rinse the baby's' mouth.

Figure 3:
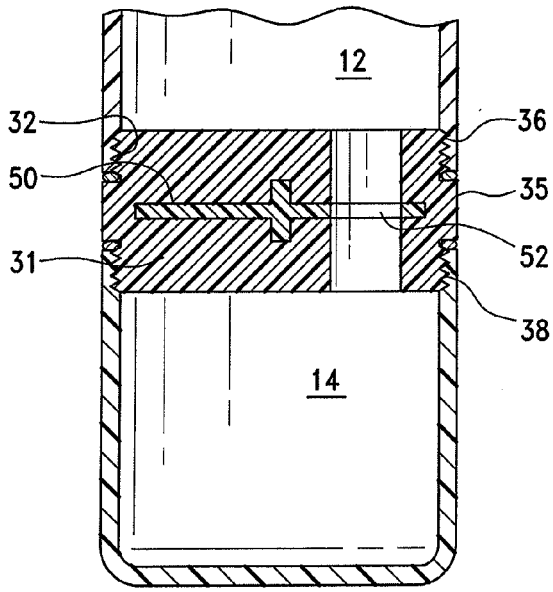
FIG. 3 is a schematic illustration of a rotary valve of a type used in the present invention.

The twist valve 35 is shown in more detail in FIG. 3. As shown, the valve 35 includes a rotatable disc 50 which includes an opening 52. When the valve is moved into its opened position, the opening in the rotatable disc 50 is aligned with an opening 54 in the valve 35. By contrast, moving the opening in the rotatable disc 50 closes the valve 35 and prevents water from the lower chamber from entering the upper chamber.

While the invention has been described in connection with its preferred embodiment, it should be recognized that changes and modifications may be made therein without departing from the scope of the appended claims.

What is claimed is:

1. A dual chamber nursery bottle comprising cylindrically shaped upper and lower chambers having a generally circular cross-section with equal diameters for containing first and second liquids respectively disposed on a common axis and said upper chamber defining an open mouth in an upper portion thereof with a first rim around said open mouth; and further defining an internally threaded open bottom with a second rim around said open bottom; and a flexible nipple and collar positioning said nipple in sealing engagement with said first rim; said lower chamber defining a closed bottom and an internally threaded open top having a third rim; and a circular rotary valve assembly having a diameter equal to the diameter of said upper and lower chambers and including an externally threaded upper portion with a first shoulder and an externally threaded lower portion with a second shoulder; and means for sealingly connecting said upper and lower chambers to said valve assembly including a pair of sealing rings, and said circular rotary valve disposed between said upper and said lower chambers on said common axis with said externally threaded upper portions of said rotary valve engaging said internally threaded portion of said upper chamber with a first of said sealing rings in sealing engagement between said second rim and said first shoulder with a second of said pair of sealing rings disposed between said upper and said lower shoulders on said common axis with said externally threaded lower portion of said rotary valve engaging said internally threaded upper portion of said lower chamber with a second of said sealing rings in sealing engagement between said third rim and said second shoulder; and said rotary valve separating said chambers when in a closed position and connecting said chambers when in an opened position and wherein said rotary valve assembly is manually moveable to said open and said closed positions irrespective of whether said nursery bottle is in use or not in use and wherein the rotary valve is open and closed by rotation about the common axis.

* * * * *